US009745165B2

(12) United States Patent
Naoi et al.

(10) Patent No.: US 9,745,165 B2
(45) Date of Patent: Aug. 29, 2017

(54) IMAGE FORMING APPARATUS

(71) Applicant: Konica Minolta, Inc., Chiyoda-ku, Tokyo (JP)

(72) Inventors: Shinya Naoi, Toyokawa (JP); Akio Kimura, Kosai (JP); Yuki Doshida, Toyokawa (JP); Yoshiki Matsui, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/190,780

(22) Filed: Jun. 23, 2016

(65) Prior Publication Data

US 2016/0378044 A1 Dec. 29, 2016

(30) Foreign Application Priority Data

Jun. 25, 2015 (JP) ..... 2015-127913

(51) Int. Cl.
*B65H 85/00* (2006.01)
*B65H 29/58* (2006.01)
(Continued)

(52) U.S. Cl.
CPC ..... *B65H 29/58* (2013.01); *B65H 29/125* (2013.01); *B65H 29/60* (2013.01); *B65H 85/00* (2013.01); *B65H 2301/33312* (2013.01); *B65H 2301/448* (2013.01); *B65H 2402/45* (2013.01); *B65H 2402/64* (2013.01); *B65H 2403/946* (2013.01); *B65H 2404/632* (2013.01);
(Continued)

(58) Field of Classification Search
CPC .... B65H 29/58; B65H 29/60; B65H 2404/63; B65H 2404/632; B65H 2301/448
See application file for complete search history.

(56) References Cited

U.S. PATENT DOCUMENTS 6,547,241 B2 * 4/2003 Yoshida ..... B65H 29/60 271/303
7,871,076 B2 * 1/2011 Yuzawa ..... B65H 29/58 271/303
(Continued)

FOREIGN PATENT DOCUMENTS

JP 2005-239344 A 9/2005
JP 2012-153521 A 8/2012

*Primary Examiner* — Jeremy R Severson
(74) *Attorney, Agent, or Firm* — Buchanan Ingersoll & Rooney PC

(57) ABSTRACT

An image forming apparatus includes: a conveying unit configured to convey a sheet along a conveyance path group including at least a first conveyance path and a second conveyance path joining the first conveyance path; an image forming unit; and a path switcher, wherein: the path switcher includes: a guide unit configured to rotate about a guide supporting point and rotate between a first position and a second position; a protruding portion fixed to the guide unit; a drive lever having a first pressing surface and a second pressing surface; a first force applying unit; and a second force applying unit; the drive lever includes: a first lever; a second lever; a third force applying unit; and a restraining portion configured to set a moving end on the rotation of the second lever; and the restraining portion restricts the moving end of the second lever to a predetermined position.

7 Claims, 6 Drawing Sheets

(51) Int. Cl.
*B65H 29/60* (2006.01)
*B65H 29/12* (2006.01)

(52) U.S. Cl.
CPC ..... *B65H 2555/13* (2013.01); *B65H 2601/11* (2013.01); *B65H 2801/06* (2013.01)

(56) References Cited

U.S. PATENT DOCUMENTS 8,387,980 B2 * 3/2013 Kang ..... B41J 13/009 271/225
8,838,008 B2 * 9/2014 Nara ..... B65H 29/58 271/184
9,296,582 B2 * 3/2016 Okumura ..... B65H 5/062

* cited by examiner

IMAGE FORMING APPARATUS

The entire disclosure of Japanese Patent Application No. 2015-127913 filed on Jun. 25, 2015 including description, claims, drawings, and abstract are incorporated herein by reference in its entirety.

BACKGROUND OF THE INVENTION

Field of the Invention

The present invention relates to an image forming apparatus. More particularly, the present invention relates to an image forming apparatus that includes conveyance paths separating at a branch point, and conveys sheets while switching sheet conveyance destinations at the branch point.

Description of the Related Art

Some image forming apparatuses have more than one conveyance path for sheets on which images are to be formed, and the conveyance paths separate from each other at a point. In some of such image forming apparatuses, a path switcher switches the conveyance destination of a sheet that has reached the branch point to one of the conveyance paths that separate at the branch point. The path switcher normally performs a switching operation to control a guide unit with a lever that is driven by a solenoid and a spring. By controlling the position and the posture of the guide unit through the switching operation, the path switcher can cause the sheet having reached the branch point to be conveyed through a conveyance path that is appropriately selected.

For example, JP 2005-239344 A discloses a path switcher that controls the rotational position of the guide unit that can be rotated about a supporting point with a lever that is rotated with a solenoid and a spring. In the path switcher according to JP 2005-239344 A, the lever for rotating the guide unit is formed with a first lever and a second lever, and applies force in such a direction that the first lever and the second lever move closer to each other. Further, a protruding portion of the guide unit is interposed between the first lever and the second lever. In the image forming apparatus according to JP 2005-239344 A, the rotational position of the guide unit is controlled by rotating the first lever and the second lever having the protruding portion of the guide unit interposed in between.

Meanwhile, an image forming apparatus is expected to have a higher operation speed these days. As the operation speed has increased, the conveyance velocity of each sheet being conveyed inside an image forming apparatus has become higher accordingly. In view of this, the guide unit of each path switcher is expected to perform a quicker switching operation. This is because a sheet cannot be conveyed to the downstream side of the branch point before the switching operation of the guide unit is completed.

However, a path switcher such as the above described conventional path switcher is designed to perform a switching operation in such a state where the protruding portion of the guide unit is interposed between the first lever and the second lever, and both the first lever and the second lever are in contact with the protruding portion of the guide unit. In a path switcher having such a structure, it is difficult for the guide unit to perform a quick switching operation.

During a switching operation, friction is generated between the protruding portion of the guide unit and the levers between which the protruding portion is interposed. The position for the levers to hold the protruding portion of the guide unit moves away from or moves toward the supporting points of the levers during a switching operation. The position for the levers to hold the protruding portion moves relative to the interposing surfaces of the levers between which the protruding portion is interposed.

In a path switcher having such a structure that the protruding portion of the guide unit is interposed between the levers from both sides, and is in contact with the interposing surfaces of both of the levers, a large frictional force is generated between the protruding portion of the guide unit and the interposing surfaces of the levers during a switching operation. As a result, the large frictional force between the protruding portion of the guide unit and the levers for holding the protruding portion during a switching operation turns into a high resistance to the spring and solenoid that apply the force necessary for the switching operation. As the resistance is high, the time required for the guide unit to complete the switching operation is long.

SUMMARY OF THE INVENTION

The present invention has been made to solve the above mentioned problems of conventional technologies. More specifically, an object of the present invention is to provide an image forming apparatus that can perform a quick switching operation with a path switcher provided at the branch point between conveyance paths.

To achieve the abovementioned object, according to an aspect, an image forming apparatus reflecting one aspect of the present invention comprises: a conveying unit configured to convey a sheet along a conveyance path group including at least a first conveyance path and a second conveyance path joining the first conveyance path; an image forming unit configured to form an image on the sheet being conveyed by the conveying unit; and a path switcher configured to perform a switching operation to switch a conveyance destination of the sheet having reached a branch point to one of the first conveyance path and the second conveyance path, the path switcher being provided at the branch point where the first conveyance path and the second conveyance path join each other, wherein: the path switcher includes: a guide unit configured to rotate about a guide supporting point and rotate between a first position and a second position, the conveyance destination being switched to the first conveyance path when the guide unit is located in the first position, the conveyance destination being switched to the second conveyance path when the guide unit is located in the second position; a protruding portion fixed to the guide unit at a different point from the guide supporting point; a drive lever configured to rotate about a first lever supporting point, the drive lever having a first pressing surface and a second pressing surface, the first pressing surface pressing a side surface of the protruding portion to cause the guide unit to rotate in a first direction from the second position toward the first position, the second pressing surface pressing the side surface of the protruding portion to cause the guide unit to rotate in a second direction, the second direction being the opposite direction from the first direction; a first force applying unit configured to apply force to the drive lever at a first force application point to cause the drive lever to rotate in a third direction to press the side surface of the protruding portion with one of the first pressing surface and the second pressing surface, the first force application point being different from the first lever supporting point; and a second force applying unit configured to apply force to the drive lever at a second force application point to cause the drive lever to rotate in a fourth direction to press the side surface of the protruding portion with the other one of the first pressing surface and the second pressing surface, the second force application point being different from the first lever supporting point; the drive lever includes: a first lever provided at the first lever supporting point and having the first pressing surface formed thereon; a second lever configured to rotate about a second lever supporting point formed on the first lever and having the second pressing surface formed thereon, the rotation of the second lever being relative to the first lever; a third force applying unit configured to apply force to the second lever at a third force application point to cause the second lever to rotate in a fifth direction to press the side surface of the protruding portion with the second pressing surface, the third force application point being different from the second lever supporting point; and a restraining portion configured to set a moving end on the rotation of the second lever in the fifth direction; and the restraining portion restricts the moving end of the second lever to a predetermined position, to form a space between the side surface of the protruding portion and at least one of the first pressing surface and the second pressing surface.

In the image forming apparatus according to an aspect of the present invention, the restraining portion restricts the moving end of rotation of the second lever in the fifth direction to such a position that a space is formed between the side surface of the protruding portion and at least one of the first pressing surface and the second pressing surface. As a result, the frictional force between the side surface of the protruding portion and the drive lever having the first pressing surface and the second pressing surface is restricted to a small value during a switching operation. The resistance to the force applied by the first force applying unit and the second force applying unit becomes lower accordingly. Thus, a quick switching operation can be performed with the path switcher provided at the branch point between the conveyance paths.

In the image forming apparatus described above, the first force applying unit is preferably switched between a force applying state in which the drive lever subjected to the force applied by the second force applying unit at the second force application point is caused to rotate in the third direction, despite the force applied by the second force applying unit, and a non-force applying state in which the drive lever subjected to the force applied by the second force applying unit at the second force application point has rotated in the fourth direction and moved to a rotational position from a rotational position in the force applying state; and the second force applying unit preferably applies the force to the drive lever at the second force application point, regardless of whether the first force applying unit is in the force applying state or in the non-force applying state. After the switching operation is completed, the position of the guide unit can be fixed precisely in the first position or in the second position.

In the image forming apparatus described above, the first force applying unit is preferably a solenoid actuator, the solenoid actuator being in the force applying state when energized and being in the non-force applying state when unenergized; and the second force applying unit is preferably a spring. The solenoid actuator is highly responsive to an operation performed in accordance with an operation command. The spring can be maintained in the force applying state. With this features, the spring can cause the drive lever to rotate by applying force thereto, immediately after the solenoid actuator is switched from the force applying state to the non-force applying state. That is, a quick switching operation can be performed with the path switcher provided at the branch point between the conveyance paths.

In the image forming apparatus described above, the first force applying unit preferably sets the first force application point on the first lever; the second force applying unit preferably sets the second force application point on the second lever; and the third force applying unit is preferably the same spring as the second force applying unit. In this structure, the number of springs to be used in the path switcher can be reduced.

In the image forming apparatus described above, the first force applying unit preferably sets the first force application point on the opposite side of the first lever supporting point from the first pressing surface on the first lever, and, when in the force applying state, the first force applying unit preferably pulls at the first force application point, to cause the drive lever to rotate in the third direction and press the side surface of the protruding portion with the second pressing surface of the rotating drive lever; the second lever supporting point is preferably located between the first pressing surface on the first lever and the first lever supporting point; and the second force applying unit is preferably a tension spring configured to pull at the second force application point. In this structure, the first force applying unit and the second force applying unit can be provided on the same side of the drive lever. Thus, the path switcher can be made smaller in size.

In the image forming apparatus described above, the second lever supporting point is preferably located further away from the second force applying unit than the center point of the first lever in a pulling direction of the second force applying unit is. In this structure, the strength of the first lever can be increased to endure the load applied to the first lever at the second lever supporting point.

In the image forming apparatus described above, the image forming apparatus preferably further comprises: an opening portion configured to expose the path switcher to the outside; and a cover configured to be in a close state to cover the opening portion, and in an open state to expose an inner side of the opening portion to the outside. In this structure, a sheet having a conveyance trouble in the vicinity of the path switcher can be easily removed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
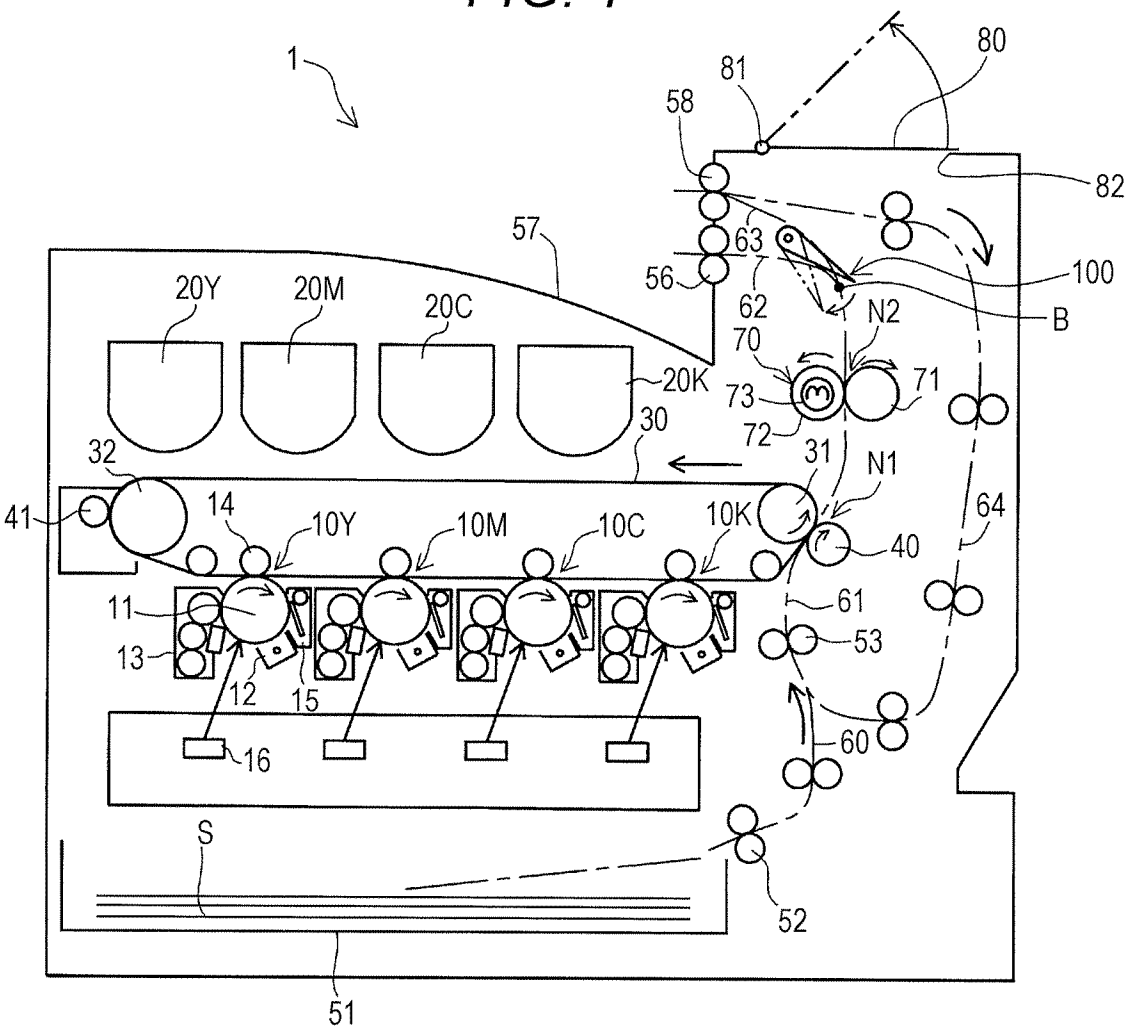
FIG. 1 is a diagram schematically showing the structure of an image forming apparatus according to an embodiment.

Hereinafter, an embodiment of the present invention will be described in detail with reference to the drawings. However, the scope of the invention is not limited to the illustrated examples. FIG. 1 schematically shows the structure of an image forming apparatus 1 of this embodiment.

The image forming apparatus 1 is a tandem color printer that includes an intermediate transfer belt 30.

The intermediate transfer belt 30 is an endless belt with conductive properties. In FIG. 1, two sides of the intermediate transfer belt 30 are supported by rollers 31 and 32. At a time of image formation, the roller 31 on the right side in FIG. 1 is rotated counterclockwise, as indicated by the arrow in the drawing. Because of this, the intermediate transfer belt 30 and the roller 32 on the left side in FIG. 1 rotate in the direction of the arrow in the drawing, following the rotation of the roller 31.

Of the intermediate transfer belt 30, a secondary transfer roller 40 is provided at the portion of the outer circumferential surface supported by the roller 31 on the right side in FIG. 1. The secondary transfer roller 40 is pressed against the intermediate transfer belt 30, in a direction perpendicular to the axis thereof (or toward the left in FIG. 1). A secondary transfer nip N1 for transferring a toner image from the intermediate transfer belt 30 onto a paper sheet S is formed at the contact portion between the intermediate transfer belt 30 and the secondary transfer roller 40. At a time of image formation, the secondary transfer roller 40 is driven to rotate in the direction of the arrow in FIG. 1 by the frictional force generated from the pressing force applied to the intermediate transfer belt 30.

Of the intermediate transfer belt 30, a belt cleaner 41 is provided at the portion of the outer circumferential surface supported by the roller 32 on the left side in FIG. 1. The belt cleaner 41 of this embodiment is in the form of a roller as shown in FIG. 1, and has a conductive brush on the surface of the core metal. The belt cleaner 41 is designed for collecting toner adhering to the surface of the intermediate transfer belt 30. That is, the belt cleaner 41 collects residual toner that has not been transferred onto the paper sheet S at the secondary transfer nip N1.

At the lower portion of the intermediate transfer belt 30 in FIG. 1, image forming units 10Y, 10M, 10C, and 10K of yellow (Y), magenta (M), cyan (C), and black (K), respectively, are arranged in this order from left to right. Each of the image forming units 10Y, 10M, 10C, and 10K forms a toner image in each corresponding color, and transfers the toner image onto the intermediate transfer belt 30. The image forming units 10Y, 10M, 10C, and 10K have the same structure as one another. In FIG. 1, reference numerals are assigned only to the image forming unit 10Y as the representative.

The image forming units 10Y, 10M, 10C, and 10K each include a photosensitive member 11 that is a cylindrical electrostatic latent image carrier, and a charging device 12, a developing device 13, primary transfer roller 14, and a photosensitive member cleaner 15 that are provided around the photosensitive member 11. An exposure device 16 is provided below the photosensitive member 11.

At a time of image formation, the photosensitive member 11 is rotated clockwise, as indicated by the arrow in FIG. 1. The charging device 12 is designed for uniformly charging the surface of the photosensitive member 11. The exposure device 16 is designed for forming an electrostatic latent image by emitting laser beams onto the surface of the photosensitive member 11 based on image data in the corresponding color. The developing device 13 is designed for applying the contained toner to the surface of the photosensitive member 11.

The primary transfer roller 14 is placed on the opposite side of the intermediate transfer belt 30 from the photosensitive member 11. The primary transfer roller 14 is pressed against the intermediate transfer belt 30, in a direction perpendicular to the axis thereof (or toward downward in FIG. 1). By virtue of this contact, a primary transfer nip for transferring a toner image on the photosensitive member 11 of the corresponding color onto the intermediate transfer belt 30 is formed at the contact portion between the intermediate transfer belt 30 and the photosensitive member 11. The photosensitive member cleaner 15 is designed for collecting the toner that has not been transferred from the photosensitive member 11 onto the intermediate transfer belt 30.

In FIG. 1, the photosensitive member cleaner 15 has a plate-like shape, and one end thereof is in contact with the outer circumferential surface of the photosensitive member 11. However, the present invention is not limited to this configuration. The photosensitive member cleaner 15 may be integrated with one or more of other cleaning members, such as a fixed brush, a rotary brush, or a roller. Alternatively, the photosensitive member cleaner 15 may not be prepared, if a cleanerless structure that collects residual toner on each photosensitive member 11 with each corresponding developing device 13 is employed.

Further, hoppers 20Y, 20M, 20C, and 20K that contain toners of the respective colors are provided above the intermediate transfer belt 30 in FIG. 1. The toners of the respective colors contained in those hoppers are supplied to the developing devices 13 for the respective colors as necessary.

A paper feed tray 51 in which paper sheets S are stacked is mounted in a lower portion of the image forming apparatus 1. In the paper feed tray 51, a paper feet path 60 is provided on the right side in FIG. 1, and extends slightly upward. The paper sheets S contained in the paper feed tray 51 are sent out one by one, starting from the uppermost one, to the paper feet path 60 by paper feed rollers 52, and are then conveyed to an image forming path 61 provided on the downstream side of the paper feet path 60.

In the image forming path 61, a pair of resist rollers 53, the secondary transfer nip N1, and a fixing device 70 are arranged in this order. The resist rollers 53 are designed for finely adjusting the timing to send out each paper sheet S to the secondary transfer nip N1. The fixing device 70 is designed for fixing, on a paper sheet S, a toner image transferred from the intermediate transfer belt 30 onto the paper sheet S at the secondary transfer nip N1.

The fixing device 70 includes a heating roller 72, and a pressure roller 71 located on the opposite side of the image forming path 61 from the heating roller 72. The heating roller 72 has a heater 73 installed therein. The pressure roller 71 is pressed against the heating roller 72, in a direction perpendicular to the axis thereof. By virtue of this contact, a fixing nip N2 for performing fixing on each paper sheet S is formed between the heating roller 72 and the pressure roller 71.

At a time of image formation, the heating roller 72 is rotated counterclockwise. As the heating roller 72 is rotated, the pressure roller 71 is driven to rotate. At the fixing nip N2, the fixing device 70 pressurizes a passing paper sheet S while heating it. By doing so, the fixing device 70 fixes the toner image carried on the paper sheet S.

A paper discharging path 62 and a reversing path 63 that join each other at a branch point B are provided on the downstream side of the fixing device 70 in the image forming path 61. At the branch point B, a path switcher 100 is provided. The path switcher 100 is designed for performing a switching operation to switch the conveyance destination of a paper sheet S that has reached the branch point B through the image forming path 61, between the paper discharging path 62 and the reversing path 63.

Specifically, when the path switcher 100 is in the paper discharging position indicated by a solid line in FIG. 1, the paper sheet S conveyed through the image forming path 61 is further conveyed into the paper discharging path 62. In the paper discharging path 62, paper discharging rollers 56 are provided. On the downstream side of the paper discharging rollers 56, a paper discharge portion 57 that receives the paper sheet S on which image formation has been completed is provided.

When the path switcher 100 is in the reversing position indicated by a dot-dot-dash line in FIG. 1, on the other hand, the paper sheet S conveyed through the image forming path 61 is further conveyed into the reversing path 63. On the downstream side of the reversing path 63, reversing rollers 58 are provided. The reversing rollers 58 are designed for reversing the direction of conveyance of the paper sheet S conveyed through the reversing path 63, and further conveying the paper sheet S into a two-side printing path 64. The path switcher 100 that performs this switching operation will be described later in detail.

The two-side printing path 64 is designed for conveying the paper sheet S that has passed through the image forming path 61 once, back into the image forming path 61. The two-side printing path 64 is connected to a point on the upper stream side of the resist rollers 53 in the image forming path 61. The paper sheet S, which has its conveying direction reversed by the reversing rollers 58, been conveyed into the two-side printing path 64, and been conveyed back into the image forming path 61, has its front and back surfaces reversed compared with those at the time when the paper sheet S was conveyed into the image forming path 61 last time.

As described above, to convey paper sheets S, the image forming apparatus 1 of this embodiment has a conveyance path group formed with the paper feet path 60, the image forming path 61, the paper discharging path 62, the reversing path 63, and the two-side printing path 64. The paper feed rollers 52, the resist rollers 53, the paper discharging rollers 56, the reversing rollers 58, and the like are conveying units that convey paper sheets S along the conveyance path group. As shown in FIG. 1, the image forming apparatus 1 includes conveyance rollers as conveying units, in addition to the paper feed rollers 52, the resist rollers 53, the paper discharging rollers 56, and the reversing rollers 58.

The image forming apparatus 1 of this embodiment further includes a cover 80 at an upper portion. The cover 80 rotates about a supporting point 81, so as to be in the close position indicated by a solid line in FIG. 1, and in the open position indicated by a dot-dot-dash line in FIG. 1. This cover 80 can be rotated between the close position and the open position by the user. The cover 80 is in the close position at normal times. When a paper sheet S has a conveyance trouble near the branch point B, the cover 80 is moved to the open position by the user.

When the cover 80 is in the open position, an opening portion 82 can be exposed to the outside. The path switcher 100 is provided on the inner side of the opening portion 82. That is, when the cover 80 is in the open position, the opening portion 82 can expose the path switcher 100 to the outside. Thus, the user can remove the paper sheet S having a conveyance trouble near the branch point B.

Figure 2:
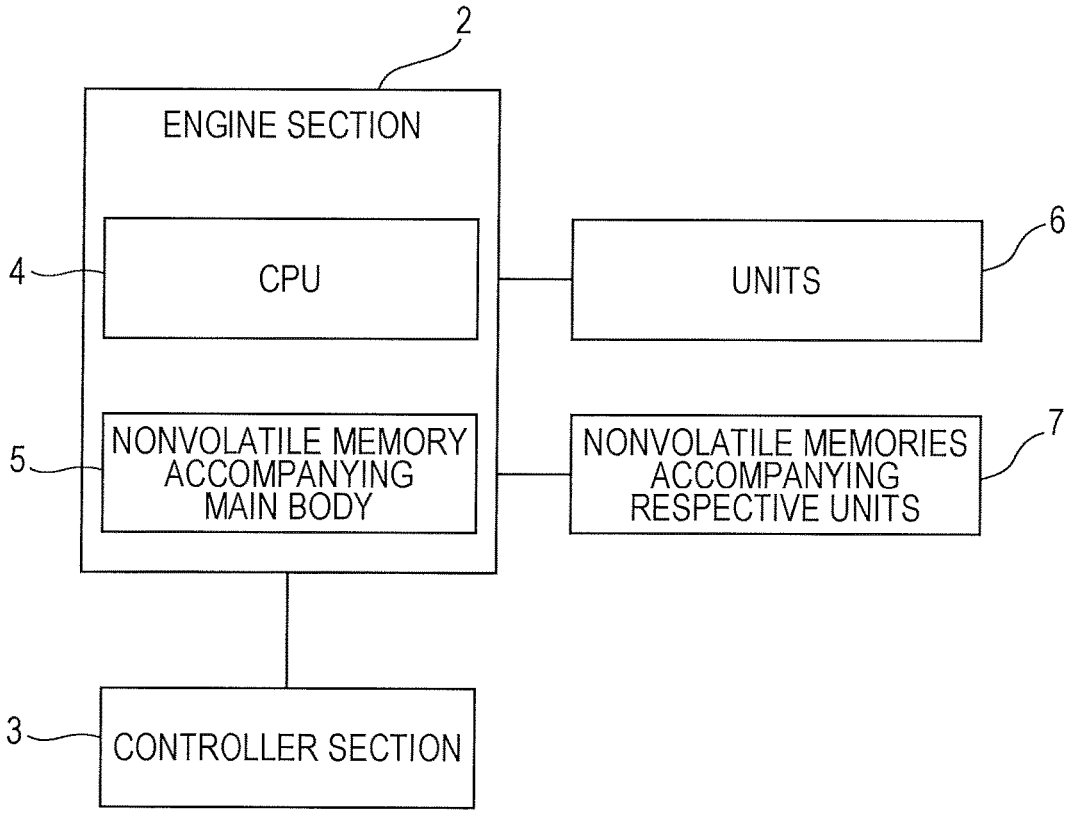
FIG. 2 is a diagram for explaining a path switcher.

FIG. 2 schematically shows the structure of the control unit of the image forming apparatus 1. To control the respective components, the image forming apparatus 1 includes an engine section 2 and a controller section 3. The engine section 2 includes a CPU 4 that controls the entire apparatus, and a nonvolatile memory 5 attached to the main body.

The nonvolatile memory 5 stores the respective values necessary for controlling the image forming apparatus 1, such as the system velocity that is the conveyance velocity of the paper sheets S, toner images, and the like.

The various units 6 shown in FIG. 2 include toner bottles and imaging units, for example. Nonvolatile memories 7 accompanying the various units 6 include: memories that accompany the toner bottles and store the remaining amounts of the respective toners, and memories that accompany the imaging units and store the numbers of paper sheets on which printing is to be printed.

The CPU 4 controls the respective components of the image forming apparatus 1 based on the data stored in the nonvolatile memory 5 and the nonvolatile memories 7. For example, the CPU 4 controls rotation of each photosensitive member 11, the timing to send out each paper sheet S with the paper feed rollers 52, and the like. The CPU 4 of this embodiment can also control switching operations at the path switcher 100 and the like.

The controller section 3 is connected to an external personal computer or the like, and receives command inputs. Receiving an image formation command from a personal computer, for example, an image formation job is generated in the image forming apparatus 1. Further, various kinds of information, such as a dot counter value, are exchanged between the engine section 2 and the controller section 3.

Next, an example of a regular image forming operation to be performed by the image forming apparatus 1 of this embodiment is briefly described. The operation described below is an example of an image forming operation in a color mode to forma color image, using toners of four colors, on paper sheets S contained in the paper feed tray 51.

In regular color image formation, the outer circumferential surface of each photosensitive member 11 is first uniformly charged by each corresponding charging device 12. The respective exposure devices 16 then project light, in accordance with image data, onto the electrically charged photosensitive members 11, and thus, electrostatic latent images are formed. The electrostatic latent images are developed by the developing devices 13, and toner images are formed on the photosensitive members 11. The toner images in the respective colors formed on the photosensitive members 11 are transferred onto the intermediate transfer belt 30 by the primary transfer roller 14 (primary transfer). Specifically, toner images in yellow (Y), magenta (M), cyan (C), and black (K) are superimposed in this order on the intermediate transfer belt 30.

The residual toner that has not been transferred onto the intermediate transfer belt 30 and remains on the photosensitive members 11 after passing through the primary transfer roller 14 is scraped off by the photosensitive member cleaners 15, and is thus removed from the surfaces of the photosensitive members 11. As the intermediate transfer belt 30 rotates, the superimposed toner images in the four colors are conveyed to the secondary transfer nip N1.

Meanwhile, the paper sheets S contained in the paper feed tray 51 are pulled out one by one, starting from the uppermost one, by the paper feed rollers 52. Each paper sheet S pulled out of the paper feed tray 51 is conveyed along the paper feet path 60 and the image forming path 61 in this order. The timing for a paper sheet S in the image forming path 61 to enter the secondary transfer nip N1 is finely adjusted by the resist rollers 53, to coincide with the timing for the toner images on the intermediate transfer belt 30 to enter the secondary transfer nip N1. With this, the superimposed toner images in the four colors are transferred onto the paper sheet S at the secondary transfer nip N1 (secondary transfer).

The residual toner still remaining on the intermediate transfer belt 30 after passing through the secondary transfer nip N1 is collected by the belt cleaner 41. With this, the residual toner is removed from the surface of the intermediate transfer belt 30.

The paper sheet S onto which the toner images have been transferred at the secondary transfer nip N1 is further conveyed to the downstream side of the image forming path 61. That is, when the paper sheet S passes through the fixing nip N2, fixing is performed on the paper sheet S. The paper sheet S that has passed through the image forming path 61 reaches the branch point B at which the path switcher 100 is located.

If the image formation on the paper sheet S has been completed at the time when the paper sheet S has passed through the image forming path 61, the path switcher 100 is in the paper discharging position indicated by the solid line in FIG. 1. That is, the paper sheet S passes through the paper discharging path 62, and is discharged onto the paper discharge portion 57 by the paper discharging rollers 56.

In the case of two-side printing for forming an image on a second surface on the opposite side from a first surface of the paper sheet S after an image has been formed on the first image at the time when the paper sheet S has passed through the image forming path 61, the path switcher 100 is in the reversing position indicated by the dot-dot-dash line in FIG. 1. As a result, the paper sheet S that has reached the path switcher 100 is conveyed to the reversing path 63, and then reaches the reversing rollers 58.

After the conveying direction is reversed by the reversing rollers 58, the paper sheet S is conveyed to the two-side printing path 64. After the bottom edge of the paper sheet S passes through the branch point B when the paper sheet S is conveyed to the reversing path 63, the path switcher 100 is in the position indicated by the solid line. This is to convey the paper sheet S that has been conveyed to the reversing path 63 and has its conveying direction inverted, into the two-side printing path 64 without fail.

As the conveying direction of the paper sheet S is reversed by the reversing rollers 58, the front and back surfaces of the paper sheet S are reversed. The paper sheet S that has passed through the two-side printing path 64 is conveyed back into the image forming path 61 by the resist rollers 53. As a result, images are formed on both the first surface and the second surface of the paper sheet S. The paper sheet S that has images formed on both surfaces then passes through the paper discharging path 62, and is discharged onto the paper discharge portion 57.

Figure 3:
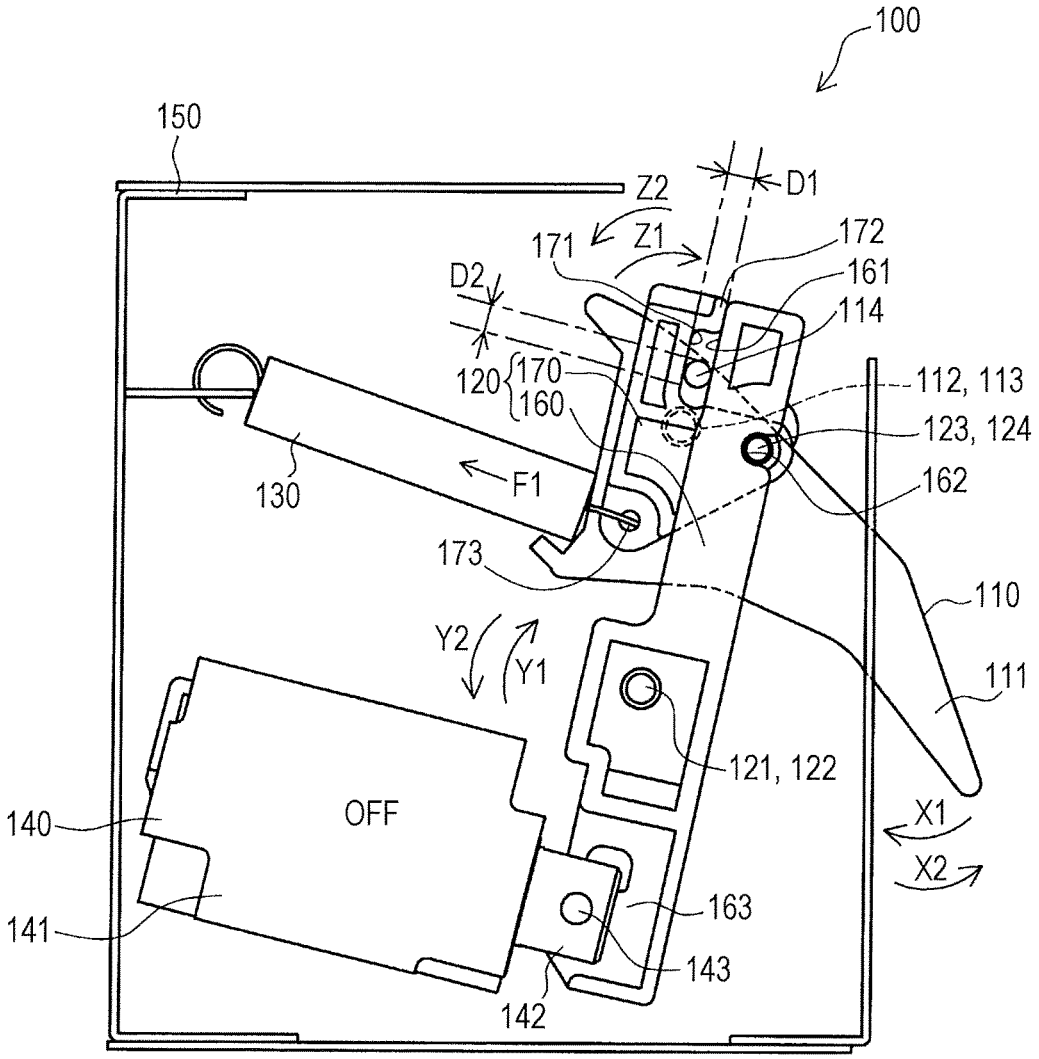
FIG. 3 is a detailed diagram of the path switcher.
Figure 4:
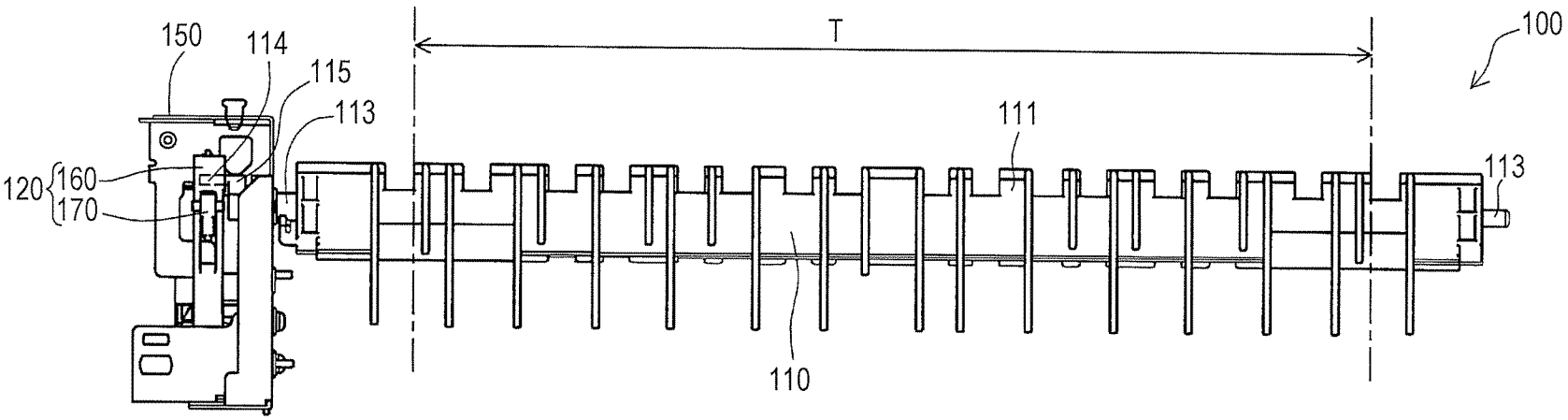
FIG. 4 is a side view of the path switcher.

Next, the structure of the path switcher 100 of this embodiment is described. FIG. 3 is a detailed diagram of the path switcher 100 of this embodiment. FIG. 4 is a side view of the path switcher 100, seen from the right side in FIG. 3.

As shown in FIG. 3, the path switcher 100 of this embodiment includes a guide unit 110, a drive lever 120, a tension spring 130, and a solenoid 140. The path switcher 100 also has a housing 150 that houses the drive lever 120, the tension spring 130, and the solenoid 140. FIG. 3 shows a situation where the path switcher 100 is in the paper discharging position indicated by the solid line in FIG. 1.

As shown in FIG. 3, the guide unit 110 includes a paper guide 111. As shown in FIG. 4, the paper guide 111 is provided in a paper passing region T through which paper sheets S pass while being conveyed. The guide unit 110 is also designed to rotate about a guide supporting shaft 113 provided at a guide supporting point 112 shown in FIG. 3.

Specifically, the guide unit 110 can rotate clockwise as indicated by an arrow X1 or counterclockwise as indicated by an arrow X2 shown in FIG. 3. As the guide unit 110 rotates about the guide supporting point 112, the position of the paper guide 111 is switched between the paper discharging position and the reversing position. With this, the guide unit 110 can switch the conveyance destination of the paper sheet S on the downstream side of the branch point B.

As shown in FIG. 4, the guide unit 110 also has a protruding portion 114 that is located on the left side of the paper guide 111 and protrudes to the left. As shown in FIG. 3, the protruding portion 114 of this embodiment is a cylindrical member provided above the guide supporting point 112. In FIG. 3, a diameter D2 of the protruding portion 114 is shown. As shown in FIG. 4, the guide unit 110 also connects the protruding portion 114 to the guide supporting shaft 113, and has a connecting portion 115 for fixing the protruding portion 114 and the guide supporting shaft 113 in the connected state.

As shown in FIG. 3, the drive lever 120 is designed to rotate about a first lever supporting shaft 122 provided at a first lever supporting point 121. Specifically, the drive lever 120 can rotate clockwise as indicated by an arrow Y1 or counterclockwise as indicated by an arrow Y2 shown in FIG. 3. In this embodiment, the first lever supporting point 121 is a supporting point at a fixed distance from and in a fixed positional relationship with the guide supporting point 112. The axial direction of the first lever supporting shaft 122 is parallel to the axial direction of the guide supporting shaft 113.

The drive lever 120 includes a first lever 160 and a second lever 170. The first lever 160 is provided on the first lever supporting shaft 122. The second lever 170 also has a second lever supporting shaft 124. The second lever supporting shaft 124 of the second lever 170 is engaged with a shaft bearing portion 162 formed in the first lever 160. The axial direction of the second lever supporting shaft 124 is parallel to the axial direction of the guide supporting shaft 113.

With this, the second lever 170 is designed to rotate about a second lever supporting point 123 in the first lever 160. Specifically, the second lever 170 can rotate clockwise as indicated by an arrow Z1 or counterclockwise as indicated by an arrow Z2 shown in FIG. 3. The second lever 170 can rotate when the first lever 160 rotates about the first lever supporting point 121, and can also rotate about the second lever supporting point 123 relative to the first lever 160.

Further, a first pressing surface 161 is formed on the left side surface of the first lever 160, as shown in FIG. 3. A second pressing surface 171 is formed on the right side surface of the second lever 170. The first pressing surface 161 and the second pressing surface 171 are place to face each other. The second lever supporting point 123 is located in a position between the first pressing surface 161 on the first lever 160 and the first lever supporting point 121.

As shown in FIG. 3, the second lever 170 has a restraining portion 172 that is located above the second pressing surface 171 and protrudes to the right relative to the second pressing surface 171. In the situation shown in FIG. 3, the restraining portion 172 is in contact with the first pressing surface 161 of the first lever 160. As the restraining portion 172 is in contact with the first pressing surface 161, the moving end of rotation of the second lever 170 in the direction of the arrow Z1 is defined.

The drive lever 120 of this embodiment is designed so that the first pressing surface 161 and the second pressing surface 171 become parallel to each other when the restraining portion 172 is brought into contact with the first pressing surface 161. FIG. 3 shows the distance D1 between the first pressing surface 161 and the second pressing surface 171 when the restraining portion 172 is in contact with the first pressing surface 161. In this embodiment, the height of the part of the restraining portion 172 protruding from the second pressing surface 171 is determined so that the distance D1 between the first pressing surface 161 and the second pressing surface 171 becomes longer than the diameter D2 of the protruding portion 114.

Further, the protruding portion 114 of the guide unit 110 is inserted between the first pressing surface 161 and the second pressing surface 171 of the drive lever 120, as shown in FIG. 3. Because of this, when the drive lever 120 rotates, the side surface of the protruding portion 114 is pressed by the first pressing surface 161 or the second pressing surface 171 of the rotating drive lever 120.

Specifically, while the drive lever 120 is rotating about the first lever supporting point 121 in the direction of the arrow Y1, the side surface of the protruding portion 114 is pressed by the second pressing surface 171 of the drive lever 120. While the drive lever 120 is rotating about the first lever supporting point 121 in the direction of the arrow Y2, the side surface of the protruding portion 114 is pressed by the first pressing surface 161 of the drive lever 120. As the protruding portion 114 is pressed by the drive lever 120, the guide unit 110 rotates about the guide supporting point 112.

As shown in FIG. 3, the left end of the tension spring 130 is fixed to the housing 150. Further, the other end or the right end of the tension spring 130 is caught by a catching hole 173 formed at a lower portion of the second lever 170 shown in FIG. 3. With this, the second lever 170 is pulled to the left at the portion of the catching hole 173 by the pulling force F1 of the tension spring 130.

Specifically, by virtue of the pulling by the tension spring 130, the second lever 170 is pulled to rotate in the direction of the arrow Z1 relative to the first lever 160. As the second lever 170 is pulled by the tension spring 130, the restraining portion 172 of the second lever 170 is in contact with the first pressing surface 161 of the first lever 160.

Also, as the second lever 170 is pulled by the tension spring 130 to rotate in the direction of the arrow Z1, the entire drive lever 120 is made to rotate in the direction of the arrow Y1. That is, the tension spring 130 is designed to constantly apply force so that the second lever 170 rotates in the direction of the arrow Z1 relative to the first lever 160, and the entire drive lever 120 rotates in the direction of the arrow Y1.

The solenoid 140 is an actuator that includes a main body 141 and a movable portion 142. The edge of the movable portion 142 of the solenoid 140 is joined to an end portion 163 located at a lower portion of the first lever 160. The end portion 163 is located on the opposite side of the first lever supporting point 121 from the first pressing surface 161 in the first lever 160. A shaft 143 penetrates through the movable portion 142 of the solenoid 140 and the end portion 163 of the first lever 160, so that the movable portion 142 and the end portion 163 are joined to each other. The main body 141 of the solenoid 140 is a stationary component.

The solenoid 140 of this embodiment is of a pull-in type that can pull the movable portion 142 into the main body 141 when energized. That is, the solenoid 140 can move the movable portion 142 to the left in an ON state that is an energized state. In an OFF state that is a non-energized state, the solenoid 140 does not apply any force to the movable portion 142.

In FIG. 3, the solenoid 140 is unenergized or in an OFF state. In FIG. 3 showing the solenoid 140 in an OFF state, the drive lever 120 is located at the moving end of rotation of the drive lever 120 that has been pulled by the pulling force F1 of the tension spring 130 and has rotated in the direction of the arrow Y1. When the solenoid 140 is in an OFF state, the path switcher 100 of this embodiment has its guide unit 110 in the paper discharging position shown in FIG. 3.

Figure 5:
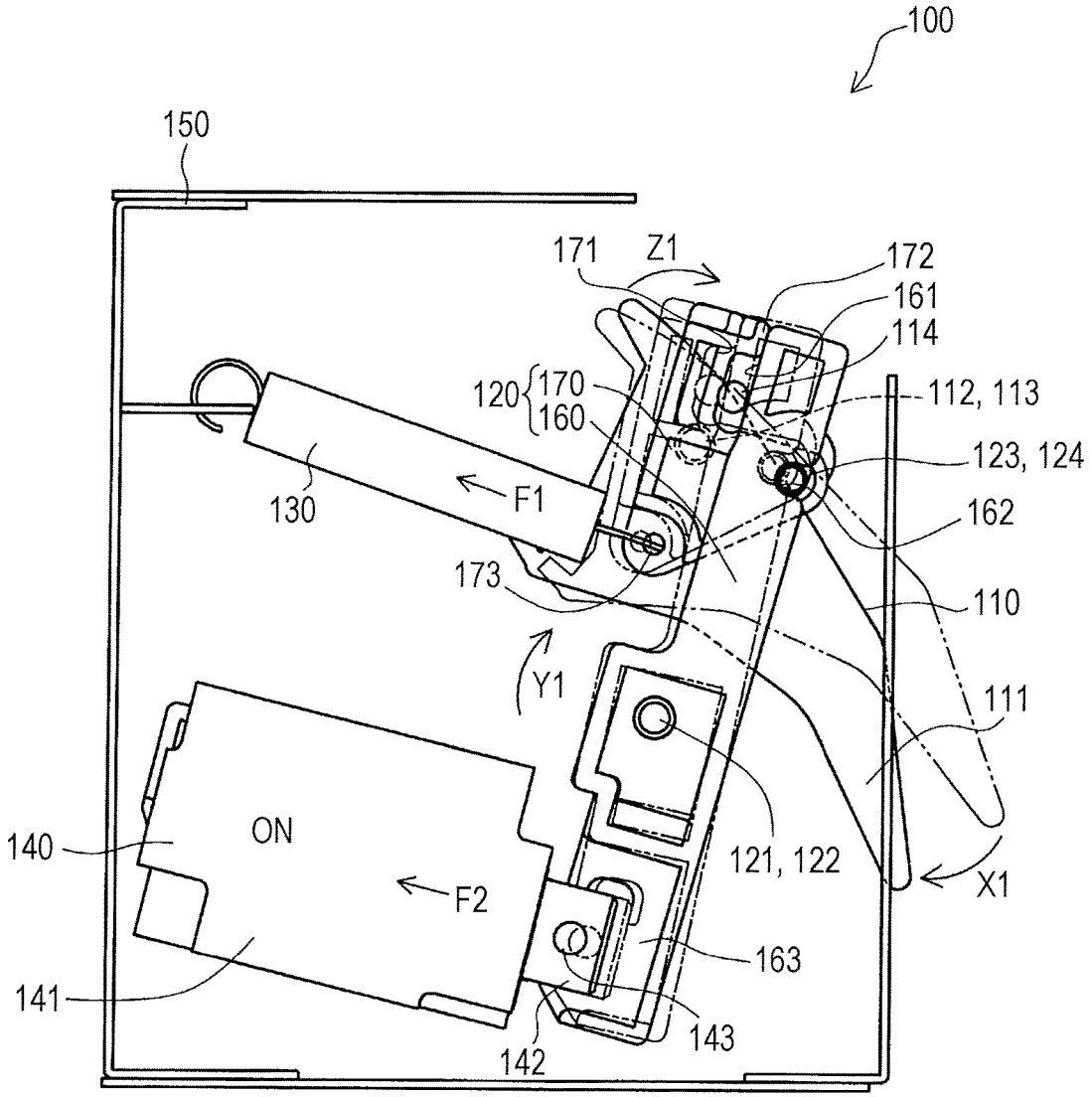
FIG. 5 is a diagram for explaining a switching operation to be performed by the path switcher.

In FIG. 5, on the other hand, a situation where the solenoid 140 is in an ON state is indicated by a solid line. In FIG. 5, a situation where the solenoid 140 is in an OFF state is indicated by a dot-dot-dash line. As described above, the movable portion 142 is pulled into the main body 141 of the solenoid 140 in an ON state shown in FIG. 5.

That is, the solenoid 140 in an ON state can cause the drive lever 120 to rotate in the direction of the arrow Y2, despite the pulling force F1 generated by the tension spring 130. In FIG. 5, a pulling force F2 that is generated when the solenoid 140 is in an ON state is shown. When the solenoid 140 is in an ON state, the path switcher 100 of this embodiment has its guide unit 110 in the reversing position shown in FIG. 5.

As described above, the path switcher 100 of this embodiment can perform a switching operation to switch the position of the guide unit 110 between the paper discharging position and the reversing position by switching the solenoid 140 between an OFF state and an ON state. It should be noted that the solenoid 140 is highly responsive to an operation performed in accordance with an operation command.

During a switching operation, the protruding portion 114 moves away from the first lever supporting point 121 or moves toward the first lever supporting point 121. This is because the guide supporting point 112 at the center of rotation of the protruding portion 114 is located in a different position from the first lever supporting point 121 at the center of rotation of the drive lever 120.

As the guide supporting point 112 and the first lever supporting point 121 are provided in different positions, the protruding portion 114 in a switching operation rotates relative to the first pressing surface 161 and the second pressing surface 171 while being located between these surfaces. That is, during a switching operation, the portion of the side surface of the protruding portion 114 facing the first pressing surface 161 moves in the circumferential direction of the protruding portion 114. Likewise, during a switching operation, the portion of the side surface of the protruding portion 114 facing the second pressing surface 171 moves in the circumferential direction of the protruding portion 114.

That is, in a case where the first pressing surface 161 and the second pressing surface 171 are in contact with the side surface of the protruding portion 114 during a switching operation, the frictional force between the side surface of the protruding portion 114 and the drive lever 120 is large. In a case where the protruding portion 114 is interposed between the first pressing surface 161 and the second pressing surface 171 so that the protruding portion 114 is in contact with both the first pressing surface 161 and the second pressing surface 171, the frictional force between the side surface of the protruding portion 114 and the drive lever 120 is even larger. In a case where the frictional force between the side surface of the protruding portion 114 and the drive lever 120 is large, the resistance to the force applied to the drive lever 120 by the tension spring 130 or the solenoid 140 is high.

In view of this, the distance D1 between the first pressing surface 161 and the second pressing surface 171 of the drive lever 120 at a time when the second lever 170 is located at the moving end of rotation in the direction of the arrow Z1 is made longer than the diameter D2 of the protruding portion 114 in this embodiment as described above. With this, when the second lever 170 is located at the moving end of rotation in the direction of the arrow Z1, a space is formed between at least one of the first pressing surface 161 and the second pressing surface 171 of the drive lever 120 and the side surface of the protruding portion 114. That is, when the second lever 170 is located at the moving end of rotation in the direction of the arrow Z1, at least one of the first pressing surface 161 and the second pressing surface 171 of the drive lever 120 is not in contact with the side surface of the protruding portion 114.

Specifically, when the solenoid 140 is switched from an OFF state to an ON state, the side surface of the protruding portion 114 is pressed by the second pressing surface 171 of the drive lever 120. While the side surface of the protruding portion 114 is pressed by the second pressing surface 171 of the drive lever 120, the first pressing surface 161 of the drive lever 120 is not in contact with the side surface of the protruding portion 114.

When the solenoid 140 is switched from an ON state to an OFF state, on the other hand, the side surface of the protruding portion 114 is pressed by the first pressing surface 161 of the drive lever 120. While the side surface of the protruding portion 114 is pressed by the first pressing surface 161 of the drive lever 120, the second pressing surface 171 of the drive lever 120 is not in contact with the side surface of the protruding portion 114.

During a switching operation, the first pressing surface 161 or the second pressing surface 171 of the drive lever 120, whichever does not press the side surface of the protruding portion 114, is not in contact with the side surface of the protruding portion 114. As a result, the frictional force generated between the protruding portion 114 and the drive lever 120 is made smaller. With this, the resistance to the force applied to the drive lever 120 by the tension spring 130 or the solenoid 140 is lowered. Thus, the path switcher 100 of this embodiment can perform a switching operation quickly.

In the path switcher 100 of this embodiment, the frictional force to be generated between the protruding portion 114 and the drive lever 120 during a switching operation is small, and therefore, a spring and a solenoid that apply small force are used as the tension spring 130 and the solenoid 140. This is because a switching operation can be performed even if the resistance to the force to be applied to the drive lever 120 by the tension spring 130 or the solenoid 140 is low, and the tension spring 130 and the solenoid 140 can apply only small force. In view of this, a spring and a solenoid that are inexpensive can be used as the tension spring 130 and the solenoid 140 in the path switcher 100. Furthermore, a spring and a solenoid that apply only small force and are small in size can be used as the tension spring 130 and the solenoid 140. That is, the path switcher 100 can be made smaller in size.

Figure 6:
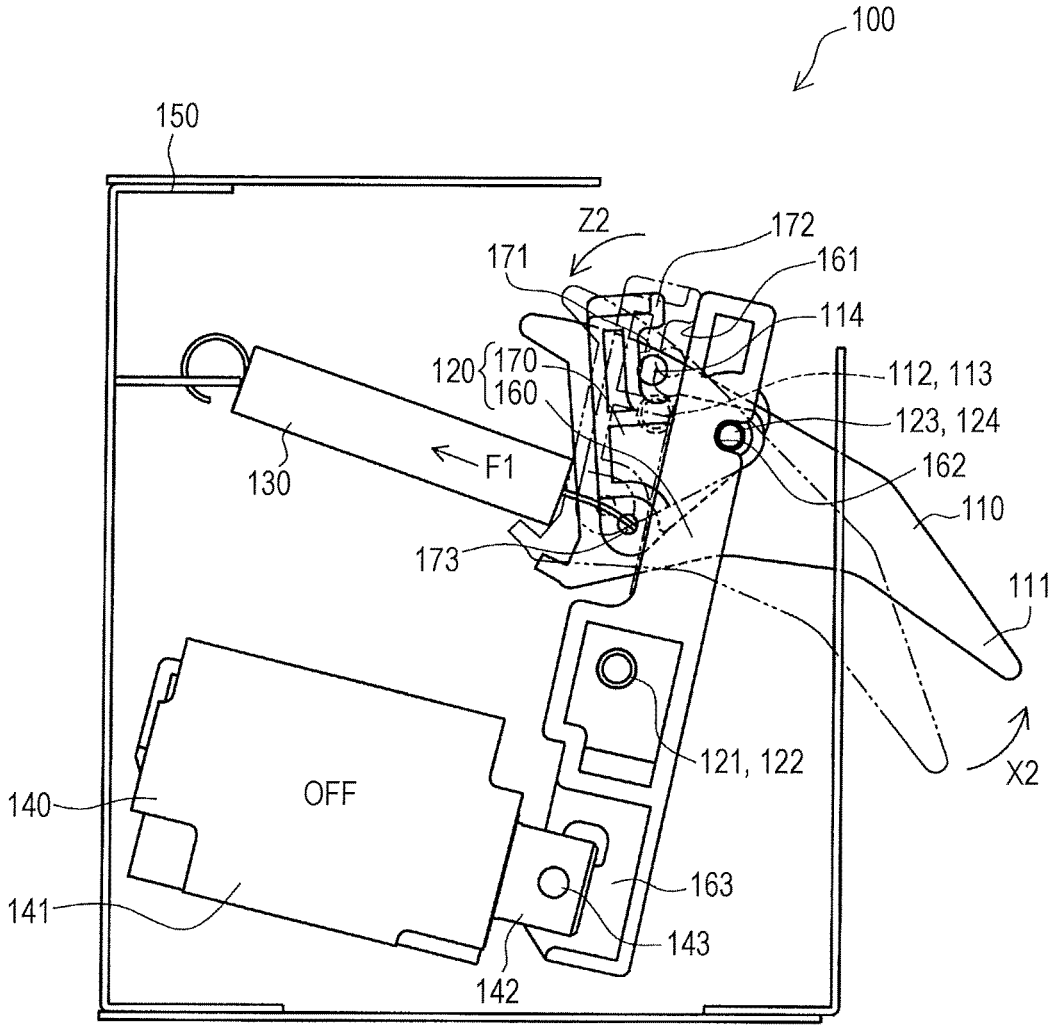
FIG. 6 is a diagram for explaining a method of removing a paper sheet having a conveyance trouble in the vicinity of the path switcher.

The path switcher 100 of this embodiment can also cause the guide unit 110 to rotate in the direction of the arrow X2, as indicated by a solid line in FIG. 6. In FIG. 6, a situation where the guide unit 110 is in the paper discharging position is indicated by a dot-dot-dash line. FIG. 6 also shows a situation where the solenoid 140 is in an OFF state. In the situation shown in FIG. 6, the paper guide 111 of the guide unit 110 has been rotated in the direction of the arrow X2 by the user.

When a paper sheet S has a conveyance trouble in the vicinity of the branch point B, the user might try to remove the paper sheet S. In such a case, the user first moves the cover 80 to the open position as indicated by a dot-dot-dash line in FIG. 1, and exposes the portion surrounding the branch point B to the outside through the opening portion 82. On the inner side of the opening portion 82, however, the paper guide 111 of the guide unit 110 might hinder the user from removing the paper sheet S. In such a case, the user causes the guide unit 110, which hinders removal of the paper sheet S, to rotate in the direction of the arrow X2, so that the paper sheet S can be smoothly removed.

When the user causes the guide unit 110 to rotate in the direction of the arrow X2, the protruding portion 114 also rotates. As shown in FIG. 6, the protruding portion 114 rotates toward the second lever 170. As a result, the second lever 170 rotates in the direction of the arrow Z2, despite the pulling force F1 generated by the tension spring 130. That is, to cause the guide unit 110 to rotate in the direction of the arrow X2, the user needs to cause the second lever 170 to rotate in the opposite direction from the direction in which the tension spring 130 applies force to the second lever 170.

At the path switcher 100 of this embodiment, however, the user can cause the guide unit 110 to rotate in the direction of the arrow X2 with only a small force. This is because a spring with the small pulling force F1 is used as the tension spring 130 in this embodiment as described above. That is, the path switcher 100 of this embodiment is designed so that the user can easily remove the paper sheet S. When the solenoid 140 is in an ON state, the user can also cause the guide unit 110 to rotate in the direction of the arrow X2.

In the path switcher 100 of this embodiment, the shaft bearing portion 162 of the first lever 160 is located in a position close to the side surface on the opposite side (the right side) of the first lever 160 from the first pressing surface 161. That is, the shaft bearing portion 162 of the first lever 160 is located in a position further away from the tension spring 130 than the center point of the first lever 160 is in the pulling direction of the tension spring 130.

The second lever 170 is constantly subjected to the leftward pulling force F1 generated by the tension spring 130, as shown in FIG. 3. Because of this, the second lever supporting shaft 124 of the second lever 170 is constantly pressed against the left side of the shaft bearing portion 162 of the first lever 160. As the shaft bearing portion 162 is located in a position further away from the tension spring 130 than the center point of the first lever 160 is in the pulling direction of the tension spring 130 in this embodiment, the first lever 160 always has sufficient strength.

This is because a portion of the first lever 160 that is closer to the tension spring 130 than the shaft bearing portion 162 of the first lever 160 is, or the portion between the first pressing surface 161 and the shaft bearing portion 162, always has a sufficient thickness. With this, the portion between the first pressing surface 161 and the shaft bearing portion 162 always has sufficient strength against the pressing force applied by the second lever supporting shaft 124 that is constantly pressed due to the force applied by the tension spring 130. Thus, damage to the first lever 160 is prevented even in a case where a large load is applied to the shaft bearing portion 162 of the first lever 160, such as when a switching operation is repeatedly performed.

In the path switcher 100 of this embodiment, the drive lever 120 is also constantly subjected to the pulling force F1 of the tension spring 130. Because of this, the rotational position of the drive lever 120 is stable after a switching operation is completed, regardless of whether the solenoid 140 is in an OFF state or in an ON state. Thus, the guide unit 110 having the protruding portion 114 inserted between the first pressing surface 161 and the second pressing surface 171 of the drive lever 120 stabilizes in the paper discharging position or in the reversing position after a switching operation is completed. That is, the path switcher 100 of this embodiment can fix the guide unit 110 precisely in the paper discharging position or in the reversing position.

In this embodiment, the tension spring 130 is caught by the catching hole 173 of the second lever 170. The single tension spring 130 applies force to cause the entire drive lever 120 to rotate in the direction of the arrow Y1, while applying force to cause the second lever 170 to rotate in the direction of the arrow Z1 relative to the first lever 160. That is, the single tension spring 130 causes rotation about the two supporting points: the first lever supporting point 121 and the second lever supporting point 123. Thus, the number of force applying members such as springs is small in this embodiment.

The tension spring 130 may be replaced with a spring that applies force so that the second lever 170 rotates in the direction of the arrow Z1 relative to the first lever 160, and another spring that applies force so that the entire drive lever 120 rotates in the direction of the arrow Y1. The springs to be used in such a case are not necessarily tension springs, but may be compression springs.

In this embodiment, the tension spring 130 and the solenoid 140 are designed to apply force to the respective portions between which the first lever supporting point 121 of the drive lever 120 is located. The tension spring 130 and the solenoid 140 are also designed to apply leftward pulling force as shown in FIG. 3. Therefore, both the tension spring 130 and the solenoid 140 are located on the left side of the drive lever 120 as shown in FIG. 3. In this arrangement, the space accommodating the tension spring 130 and the solenoid 140 is small. Thus, the path switcher 100 of this embodiment occupies only a small space in the image forming apparatus 1.

The solenoid 140 of a pull-in type that retracts the movable portion 142 at a time of energization may be replaced with a solenoid actuator of a push-out type that pushes out the movable portion 142 at a time of energization. In such a case, the solenoid actuator of a push-out type is positioned so as to push the end portion 163 of the first lever 160 to the left in FIG. 3 at a time of energization.

In the drive lever 120 of this embodiment, the restraining portion 172 sets the moving end of the second lever 170 so that the distance D1 between the first pressing surface 161 and the second pressing surface 171 becomes longer than the diameter D2 of the protruding portion 114. Because of this, even when the second lever 170 is located at the moving end of rotation in the direction of the arrow Z1, the protruding portion 114 might slightly move between the first pressing surface 161 and the second pressing surface 171.

However, the space between the side surface of the protruding portion 114 and the first pressing surface 161 or the second pressing surface 171 at a time when the second lever 170 is located at the moving end of rotation in the direction of the arrow Z1 is smaller than the distance D1. That is, the backlash of the protruding portion 114 at a time when the second lever 170 is located at the moving end of rotation in the direction of the arrow Z1 is of course not so large that the conveyance destination changes. That is, when the solenoid 140 is in an OFF state for putting the guide unit 110 into the paper discharging position, the paper sheet S having reached the branch point B is not conveyed into the reversing path 63.

The backlash of the protruding portion 114 at a time when the second lever 170 is located at the moving end of rotation in the direction of the arrow Z1 is not so large that large noise is caused in the course of a switching operation. Specifically, the restraining portion 172 is preferably designed to set the moving end of rotation of the second lever 170 in the direction of the arrow Z1 so that the maximum value of the space between the side surface of the protruding portion 114 and the first pressing surface 161 or the second pressing surface 171 becomes 0.2 mm or smaller.

As described so far in detail, the image forming apparatus 1 of this embodiment has the path switcher 100 at the branch point B. The path switcher 100 switches the position of the guide unit 110 between the paper discharging position and the reversing position by applying force to the drive lever 120, which includes the first lever 160 and the second lever 170, with the tension spring 130 and the solenoid 140. The second lever 170 of the drive lever 120 is designed to rotate about the second lever supporting point 123 located in the first lever 160. The tension spring 130 applies force to the second lever 170 in the direction of the arrow Z1, so that the second pressing surface 171 presses the side surface of the protruding portion 114. Further, the second lever 170 has the restraining portion 172 that sets the moving end of rotation of the second lever 170 in the direction of the arrow Z1. The restraining portion 172 sets the moving end of rotation of the second lever 170 in the direction of the arrow Z1 so that the distance D1 between the first pressing surface 161 and the second pressing surface 171 becomes longer than the diameter D2 of the protruding portion 114. With this, an image forming apparatus that can perform a quick switching operation with a path switcher provided at the branch point between conveyance paths is completed.

It should be noted that this embodiment is merely an example, and does not limit the present invention. Various changes and modifications may of course be made to this embodiment, without departing from the scope of the invention. For example, the present invention can be applied not only to color printers but also to image forming apparatuses such as copying machines that have a path switcher for switching conveyance paths at a branch point. The present invention can be applied not only to the path switcher 100 at the branch point B in the image forming apparatus 1 described in the above embodiment, but also to any path switcher that switches conveyance paths at a branch point. In a case where an image forming apparatus has more than one branch point accompanied by a path switcher, for example, the present invention can be applied to the respective path switchers at all the branch points.

Also, the tension spring 130 may be replaced with a compression spring that is located in the position of the tension spring 130 shown in FIG. 3 and presses the first lever 160 to the right, and the solenoid 140 of a pull-in type may be replaced with a solenoid of a push-out type that is located in the position of the solenoid 140 shown in FIG. 3, for example. In this case, a spring that has its ends connected to the first lever 160 and the second lever 170, and applies force to move the second lever 170 in the direction of the arrow Z1 should be further provided. In this structure, the solenoid in an ON state applies force so that the drive lever 120 rotates in the direction of the arrow Y2 to press the side surface of the protruding portion 114 with the first pressing surface 161. Also in this structure, when the solenoid is in an OFF state, the compression spring applies force so that the drive lever 120 rotates in the direction of the arrow Y1 to press the side surface of the protruding portion 114 with the second pressing surface 171.

Alternatively, the solenoid 140 may be replaced with a solenoid actuator of a double-acting type that is located in the position of the solenoid 140 shown in FIG. 3, and performs both a pull-in action and a push-out action, for example. In this case, the tension spring 130 is not necessary. A spring that has its ends connected to the first lever 160 and the second lever 170, and applies force to move the second lever 170 in the direction of the arrow Z1 should also be provided in this case. In a case where a solenoid of a double-acting type is used, the action of the solenoid is switched between a pull-in action and a push-out action, to cause the entire drive lever 120 to rotate in the direction of the arrow Y1 or the arrow Y2.

In the above described embodiment, the first pressing surface 161 and the second pressing surface 171 are parallel to each other when the second lever 170 is located at the moving end of rotation in the direction of the arrow Z1. However, the first pressing surface 161 and the second pressing surface 171 may not be parallel to each other at such a time. In other words, one of the two surfaces may be tilted toward the other. However, the first pressing surface 161 and the second pressing surface 171 are preferably flat surfaces. During a switching operation, the side surface of the protruding portion 114 slides on the first pressing surface 161 or the second pressing surface 171, whichever is pressing the side surface of the protruding portion 114. If the first pressing surface 161 and the second pressing surface 171 are not flat surfaces, the friction with the side surface of the protruding portion 114 during a switching operation becomes larger. This hinders a quick switching operation.

In the above described embodiment, the second lever 170 has the restraining portion 172. However, a restraining portion may be provided on the side of the first lever 160, for example. A restraining portion can be provided in such a position as to set the moving end of rotation of the second lever 170 relative to the first lever 160 in the direction of the arrow Z1.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a conveying unit configured to convey a sheet along a conveyance path group including at least a first conveyance path and a second conveyance path joining the first conveyance path;

an image forming unit configured to form an image on the sheet being conveyed by the conveying unit; and a path switcher configured to perform a switching operation to switch a conveyance destination of the sheet having reached a branch point to one of the first conveyance path and the second conveyance path, the path switcher being provided at the branch point where the first conveyance path and the second conveyance path join each other, wherein:

the path switcher includes:

a guide unit configured to rotate about a guide supporting point and rotate between a first position and a second position, the conveyance destination being switched to the first conveyance path when the guide unit is located in the first position, the conveyance destination being switched to the second conveyance path when the guide unit is located in the second position;

a protruding portion fixed to the guide unit at a different point from the guide supporting point;

a drive lever configured to rotate about a first lever supporting point, the drive lever having a first pressing surface and a second pressing surface, the first pressing surface pressing a side surface of the protruding portion to cause the guide unit to rotate in a first direction from the second position toward the first position, the second pressing surface pressing the side surface of the protruding portion to cause the guide unit to rotate in a second direction, the second direction being the opposite direction from the first direction;

a first force applying unit configured to apply force to the drive lever at a first force application point to cause the drive lever to rotate in a third direction to press the side surface of the protruding portion with one of the first pressing surface and the second pressing surface, the first force application point being different from the first lever supporting point; and a second force applying unit configured to apply force to the drive lever at a second force application point to cause the drive lever to rotate in a fourth direction to press the side surface of the protruding portion with the other one of the first pressing surface and the second pressing surface, the second force application point being different from the first lever supporting point;

the drive lever includes:

a first lever provided at the first lever supporting point and having the first pressing surface formed thereon;

a second lever configured to rotate about a second lever supporting point formed on the first lever and having the second pressing surface formed thereon, the rotation of the second lever being relative to the first lever;

wherein the second force applying unit is further configured to apply force to the second lever at a third force application point to cause the second lever to rotate in a fifth direction to press the side surface of the protruding portion with the second pressing surface, the third force application point being different from the second lever supporting point; and a restraining portion configured to set a moving end on the rotation of the second lever in the fifth direction; and the restraining portion restricts the moving end of the second lever to a predetermined position, to form a space between the side surface of the protruding portion and at least one of the first pressing surface and the second pressing surface.

2. The image forming apparatus according to claim 1, wherein:

the first force applying unit is switched between a force applying state in which the drive lever subjected to the force applied by the second force applying unit at the second force application point is caused to rotate in the third direction, despite the force applied by the second force applying unit, and a non-force applying state in which the drive lever subjected to the force applied by the second force applying unit at the second force application point has rotated in the fourth direction and moved to a rotational position from a rotational position in the force applying state; and the second force applying unit applies the force to the drive lever at the second force application point, regardless of whether the first force applying unit is in the force applying state or in the non-force applying state.

3. The image forming apparatus according to claim 2, wherein:

the first force applying unit is a solenoid actuator, the solenoid actuator being in the force applying state when energized and being in the non-force applying state when unenergized; and the second force applying unit is a spring.

4. The image forming apparatus according to claim 3, wherein:

the first force applying unit sets the first force application point on the first lever; and the second force applying unit sets the second force application point on the second lever.

5. The image forming apparatus according to claim 4, wherein:

the first force applying unit sets the first force application point on the opposite side of the first lever supporting point from the first pressing surface on the first lever, and, when in the force applying state, the first force applying unit pulls at the first force application point, to cause the drive lever to rotate in the third direction and press the side surface of the protruding portion with the second pressing surface of the rotating drive lever;

the second lever supporting point is located between the first pressing surface on the first lever and the first lever supporting point; and the second force applying unit is a tension spring configured to pull at the second force application point.

6. The image forming apparatus according to claim 5, wherein the second lever supporting point is located further away from the second force applying unit than the center point of the first lever in a pulling direction of the second force applying unit is.

7. The image forming apparatus according to claim 1, further comprising:

an opening portion configured to expose the path switcher to the outside; and a cover configured to be in a close state to cover the opening portion, and in an open state to expose an inner side of the opening portion to the outside.

* * * * *